US010203619B2

(12) United States Patent
Yamashita et al.

(10) Patent No.: US 10,203,619 B2
(45) Date of Patent: Feb. 12, 2019

(54) TONER AND METHOD FOR PRODUCING TONER

(71) Applicant: CANON KABUSHIKI KAISHA, Tokyo (JP)

(72) Inventors: Daisuke Yamashita, Tokyo (JP); Takashi Hirasa, Moriya (JP); Hayato Ida, Toride (JP); Junichi Tamura, Toride (JP); Takaho Shibata, Tokyo (JP); Ryuji Murayama, Nagareyama (JP); Kouichirou Ochi, Chiba (JP); Yuya Chimoto, Funabashi (JP); Tomoyo Miyakai, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/687,726

(22) Filed: Aug. 28, 2017

(65) Prior Publication Data

US 2018/0067410 A1 Mar. 8, 2018

(30) Foreign Application Priority Data

Sep. 6, 2016 (JP) ..... 2016-173352
Jul. 27, 2017 (JP) ..... 2017-145311

(51) Int. Cl.
*G03G 9/08* (2006.01)
*G03G 9/087* (2006.01)

(52) U.S. Cl.
CPC ..... *G03G 9/08724* (2013.01); *G03G 9/0804* (2013.01); *G03G 9/0821* (2013.01); *G03G 9/08722* (2013.01); *G03G 9/08773* (2013.01); *G03G 9/08795* (2013.01); *G03G 9/08797* (2013.01)

(58) Field of Classification Search
CPC . G03G 9/08724; G03G 9/0821; G03G 9/0804
See application file for complete search history.

(56) References Cited

U.S. PATENT DOCUMENTS

| | | | |
|---|---|---|---|
| 6,030,739 | A | 2/2000 | Ishikawa et al. |
| 6,153,346 | A | 11/2000 | Maehata et al. |
| 7,833,687 | B2 | 11/2010 | Kato et al. |
| 8,697,327 | B2 | 4/2014 | Shibata et al. |
| 9,057,970 | B2 | 6/2015 | Ida et al. |
| 9,348,247 | B2 | 5/2016 | Ida et al. |
| 9,540,483 | B2 | 1/2017 | Ida et al. |
| 9,696,644 | B2 | 7/2017 | Ida et al. |
| 2013/0108955 | A1 | 5/2013 | Shibata et al. |
| 2013/0202998 | A1 | 8/2013 | Higashi et al. |
| 2015/0099227 | A1 | 4/2015 | Ida et al. |

FOREIGN PATENT DOCUMENTS

| | | | |
|---|---|---|---|
| JP | S59-018954 | A | 1/1984 |
| JP | H02-003073 | A | 1/1990 |
| JP | H04-021860 | A | 1/1992 |
| JP | H08-184986 | A | 7/1996 |
| JP | H11-202555 | A | 7/1999 |
| JP | H11-311877 | A | 11/1999 |
| JP | H11-316472 | A | 11/1999 |
| JP | 2001-166524 | A | 6/2001 |
| JP | 2007-264333 | A | 10/2007 |
| JP | 2011-107261 | A | 6/2011 |
| JP | 2015-175938 | A | 10/2015 |

OTHER PUBLICATIONS

U.S. Appl. No. 15/527,191, Takaho Shibata, filed May 16, 2017.
U.S. Appl. No. 15/532,543, Junichi Tamura, filed Jun. 2, 2017.
U.S. Appl. No. 15/693,662, Hayato Ida, filed Sep. 1, 2017.

*Primary Examiner* — Thorl Chea
(74) *Attorney, Agent, or Firm* — Venable LLP

(57) ABSTRACT

A toner including: a binder resin containing an ethylene-vinyl acetate copolymer; a polysiloxane derivative A represented by structural formula 1; and a polysiloxane derivative B represented by structural formula 2:

(1)

(in structural formula 1, $R_1$ to $R_{10}$ each independently represent a methyl group or a phenyl group, and l, m and n each independently represent an integer of at least 1)

(2)

(in structural formula 2, at least one of $R_{11}$ to $R_{20}$ is an organic group having a $C_{4-30}$ alkyl group, a $C_{4-30}$ alkoxy group, an acrylic group, an amino group, a methacrylic group or a carboxyl group, the remaining groups among $R_{11}$ to $R_{20}$ each independently represent a methyl group or a phenyl group, and p, q and r each independently represent an integer of at least 1).

11 Claims, 1 Drawing Sheet

TONER AND METHOD FOR PRODUCING TONER

BACKGROUND OF THE INVENTION

Field of the Invention

The present invention relates to a toner used in an electrophotographic system, and a method for producing a toner.

Description of the Related Art

In electrophotographic processes, a heat fixing process, in which a toner image formed on an image formation member by means of development is transferred to a recording medium such as paper and is then heated, is generally employed. Among heat fixing processes, fixing systems that use heated rollers as heating means exhibit good heat transfer efficiency, and have therefore become widely used in recent years.

However, because a toner image and the surface of a fixing roller are subjected to pressure contact in a hot molten state in such systems, there are concerns regarding the occurrence of so-called hot offset, in which a part of the toner adheres to the surface of the fixing roller and is then transferred to the next recording medium, thereby contaminating the recording medium.

As a result, incorporating an olefin-based compound such as an alkyl wax as a release agent in a toner and incorporating a silicone oil in a toner have been proposed as methods for tackling this problem (see Japanese Patent Application Laid-open Nos. 2007-264333, 2001-166524, H11-316472 and H02-3073).

Meanwhile, as demands for reduced energy consumption in image formation methods have increased in recent years, attempts have been made to lower toner fixing temperatures. As methods for improving low temperature fixability, proposals have been made to lower fixing temperatures by using resins having low glass transition temperatures. Toners containing ethylene-vinyl acetate copolymers as resins having low glass transition temperatures have been proposed (see Japanese Patent Application Laid-open Nos. S59-18954, 2011-107261, H11-202555, H08-184986 and H04-21860).

In addition, emulsion aggregation methods have gained attention as toner production methods due to being able to easily control the particle size distribution, particle size and shape of a toner. Emulsion aggregation methods are production methods comprising aggregating particles in a dispersed solution that contains resin fine particles in an aqueous medium so as to form aggregate particles, and then forming toner particles by heating and fusing the aggregate particles (see Japanese Patent Application Laid-open Nos. 2015-175938 and H11-311877).

SUMMARY OF THE INVENTION

The inventors of the present invention attempted to develop a toner in which an ethylene-vinyl acetate copolymer was used as a binder resin in order to improve low temperature fixability, but it was clear that when an ethylene-vinyl acetate copolymer is used as a binder resin, hot offset resistance is worse than in ordinary toners.

Incorporating a release agent in a toner so that the release agent migrates out to the interface between the fixing member and the toner during fixing, thereby improving hot offset resistance, is generally known as a method for improving hot offset resistance in toners.

As a result of investigations, however, the inventors of the present invention did not observe an improvement in hot offset resistance in cases where an ethylene-vinyl acetate copolymer was used as a binder resin due to ethylene-vinyl acetate copolymers being strongly hydrophobic and being compatible with waxes commonly used in toners, such as alkyl waxes. This was particularly noticeable in cases where an ethylene-vinyl acetate copolymer accounted for at least 50 mass % of the binder resin.

As a result, investigations were carried out into adding a polysiloxane derivative represented by structural formula 1 below, which can be expected to achieve a release effect without being compatible with an ethylene-vinyl acetate copolymer.

However, this polysiloxane derivative is a liquid, and the polysiloxane derivative has extremely low affinity for the ethylene-vinyl acetate copolymer, which mean that the polysiloxane derivative migrates out to the toner surface during long term storage, thereby causing a deterioration in toner flowability.

In addition, attempts were made to produce toners using emulsion aggregation methods in which the particle diameter and particle size distribution of toners can be easily controlled. As a result, because this polysiloxane derivative has low affinity for the ethylene-vinyl acetate copolymer, it was difficult to incorporate a sufficient amount of the polysiloxane derivative in the toner to achieve a sufficient release effect.

The present invention provides a toner which exhibits good low temperature fixability, excellent hot offset resistance and satisfactory flowability following long term storage even if an ethylene-vinyl acetate copolymer is used as a binder resin; and a method for producing the toner.

(Structural formula 1)

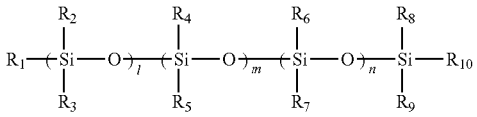

(In the structural formula 1, $R_1$ to $R_{10}$ each independently represent a methyl group or a phenyl group, and l, m and n each independently represent an integer of at least 1.)

The present invention is a toner including: a binder resin containing an ethylene-vinyl acetate copolymer; a polysiloxane derivative A represented by structural formula 1 below; and a polysiloxane derivative B represented by structural formula 2 below.

In addition, the present invention is a method for producing a toner, the method including:

a step of emulsifying a polysiloxane derivative A represented by structural formula 1 below and a polysiloxane derivative B represented by structural formula 2 below so as to obtain emulsified particles of the polysiloxane derivative A and the polysiloxane derivative B;

a step of finely pulverizing a binder resin containing an ethylene-vinyl acetate copolymer so as to obtain resin fine particles;

a step of aggregating the emulsified particles and the resin fine particles so as to obtain aggregates; and a fusion step of fusing the aggregates.

(Structural formula 1)

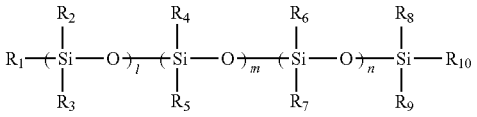

(In the structural formula 1, $R_1$ to $R_{10}$ each independently represent a methyl group or a phenyl group, and l, m and n each independently represent an integer of at least 1.)

(Structural formula 2)

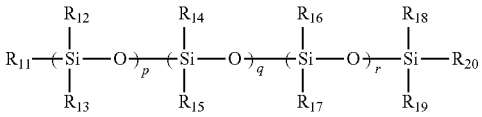

(In the structural formula 2, at least one of $R_{11}$ to $R_{20}$ is an organic group having a $C_{4-30}$ alkyl group, a $C_{4-30}$ alkoxy group, an acrylic group, an amino group, a methacrylic group or a carboxyl group, the remaining groups among $R_{11}$ to $R_{20}$ each independently represent a methyl group or a phenyl group, and p, q and r each independently represent an integer of at least 1.)

Further features of the present invention will become apparent from the following description of exemplary embodiments with reference to the attached drawings.

DESCRIPTION OF THE EMBODIMENTS

Figure 1A:
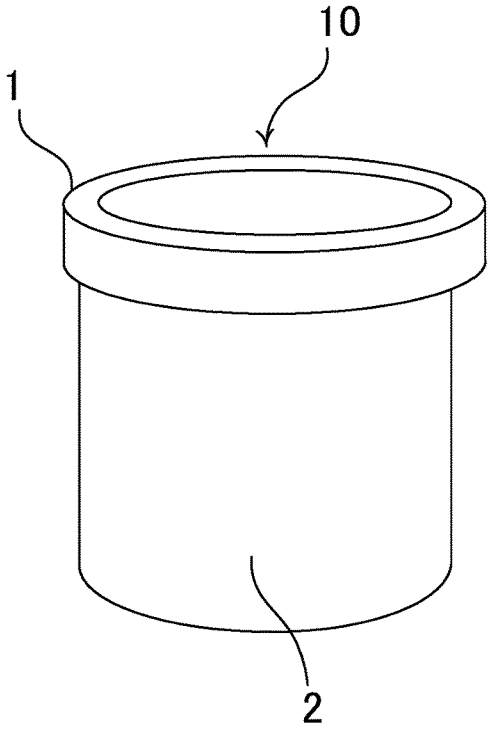
FIGS. 1A and 1B are diagrams that explain polysiloxane derivative introduction rate measurements.

In the present invention, the terms "at least XX and not more than YY" and "XX to YY", which indicate numerical ranges, mean numerical ranges that include the lower limits and upper limits that are the end points of the ranges.

The toner of the present invention is characterized by including: a binder resin containing an ethylene-vinyl acetate copolymer; a polysiloxane derivative A represented by structural formula 1 above; and a polysiloxane derivative B represented by structural formula 2 above.

As a result of diligent research, the inventors of the present invention found that by using a combination of an ethylene-vinyl acetate copolymer, a polysiloxane derivative A represented by structural formula 1 above (hereinafter referred to simply as polysiloxane derivative A) and a polysiloxane derivative B represented by structural formula 2 above (hereinafter referred to simply as polysiloxane derivative B), it is possible to significantly improve hot offset resistance without causing a deterioration in flowability following long term storage.

Because the polysiloxane derivative A has extremely low affinity for the ethylene-vinyl acetate copolymer and is a liquid, in cases where only the polysiloxane derivative A is used, the polysiloxane derivative A in the toner migrates out to the toner surface during long-term storage, which leads to a deterioration in toner flowability.

Because the polysiloxane derivative B has an organic group moiety having a high affinity for the ethylene-vinyl acetate copolymer, cases where only the polysiloxane derivative B is used are advantageous in terms of the polysiloxane derivative B being unlikely to migrate out to the toner surface even after long term storage. However, the organic group moiety having a high affinity plasticizes the ethylene-vinyl acetate copolymer, meaning that it is not possible to improve hot offset resistance.

Meanwhile, in cases where the polysiloxane derivative A and the polysiloxane derivative B are used in combination, the polysiloxane derivative B, which has an organic group moiety having a high affinity for the ethylene-vinyl acetate copolymer and a siloxane moiety having high affinity for the polysiloxane derivative A, has the role of keeping the polysiloxane derivative A in the inner part of the toner. Therefore, it is possible to improve hot offset resistance without causing a deterioration in flowability following long term storage.

In addition, when producing a toner by means of an emulsion aggregation method, in cases where only the polysiloxane derivative A is used, because the polysiloxane derivative A has a low affinity for the ethylene-vinyl acetate copolymer, it is difficult to incorporate a sufficient amount of the polysiloxane derivative A to improve hot offset resistance. The polysiloxane derivative A tends to escape from the toner in a step such as aggregation, fusion or washing, which are described later.

However, in cases where the polysiloxane derivative A and the polysiloxane derivative B are used in combination, the polysiloxane derivative B also functions as an aid for introducing the polysiloxane derivative A, and makes it possible to incorporate a sufficient amount of the polysiloxane derivative A in the toner.

From the perspective of low temperature fixability at high speed output, the content of the ethylene-vinyl acetate copolymer in the binder resin is preferably at least 50 mass % and not more than 100 mass %, more preferably at least 70 mass % and not more than 90 mass %, and further preferably at least 70 mass % and not more than 80 mass %.

Because the ethylene-vinyl acetate copolymer has a glass transition temperature of not more than 0° C., low temperature fixability at high speed output are improved when the content of the ethylene-vinyl acetate copolymer in the binder resin is at least 50 mass %.

The content of monomer units derived from vinyl acetate in the ethylene-vinyl acetate copolymer is preferably at least 5 mass % and not more than 20 mass %, and more preferably at least 5 mass % and not more than 15 mass %. Moreover, monomer unit means a mode in which a monomer substance has reacted in a polymer or resin.

When the content of monomer units derived from vinyl acetate is not more than 20 mass %, charging performance of the toner is improved. Meanwhile, when this content is at least 5 mass %, adhesive properties to paper are improved and low temperature fixability are improved.

From the perspectives of toner strength and blocking resistance following long term storage, the melt flow rate of the ethylene-vinyl acetate copolymer is preferably not more than 30 [g/10 min].

In addition, from the perspectives of impact resistance and pressure resistance during toner usage, the melt flow rate is more preferably not more than 20 [g/10 min].

Meanwhile, from the perspective of image gloss, the melt flow rate is preferably at least 5 [g/10 min].

In cases where an ethylene-vinyl acetate copolymer having a melt flow rate of not more than 30 [g/10 min] is used at an amount of at least 50 mass % of the binder resin, it is difficult to pulverize the toner, and producing the toner using a pulverization method (that is, a melt kneading method) is difficult. Therefore, an emulsion aggregation method is preferred as the method for producing the toner.

In the present invention, melt flow rate is measured in accordance with JIS K 7210, at a temperature of 190° C. and a load of 2160 g.

The melt flow rate can be controlled by altering the molecular weight of the ethylene-vinyl acetate copolymer. For example, the melt flow rate can be lowered by increasing the molecular weight.

The weight average molecular weight of the ethylene-vinyl acetate copolymer is preferably at least 50,000 and not more than 500,000, and more preferably at least 100,000 and not more than 500,000, from the perspective of adjusting the melt flow rate and from the perspective of image gloss.

The fracture elongation of the ethylene-vinyl acetate copolymer is preferably at least 300%, and more preferably at least 500%. In addition, the upper limit for the fracture elongation is not particularly limited, but is preferably not more than 1500%.

When the fracture elongation is at least 300%, the bending resistance of a toner-fixed article is improved.

Moreover, by increasing the molecular weight of the ethylene-vinyl acetate copolymer, the fracture elongation can be increased.

The ethylene-vinyl acetate copolymer may be an ethylene-vinyl acetate copolymer that is modified to a degree whereby the characteristics of the copolymer are not substantially impaired.

Examples of methods for modifying the ethylene-vinyl acetate copolymer include a method of partially mixing and polymerizing a monomer other than ethylene and vinyl acetate during the polymerization and a method of saponifying a part of the ethylene-vinyl acetate copolymer.

In addition to the ethylene-vinyl acetate copolymer, the toner may contain another polymer or resin as a binder resin.

For example, it is possible to use the following polymers and resins.

Homopolymers of styrene and substituted products thereof, such as polystyrene, poly-p-chlorostyrene and polyvinyltoluene; styrene-based copolymers such as styrene-p-chlorostyrene copolymers, styrene-vinyltoluene copolymers, styrene-vinylnaphthalene copolymers, styrene-acrylic acid ester copolymers and styrene-methacrylic acid ester copolymers; poly(vinyl chloride), phenol resins, natural resin-modified phenol resins, natural resin-modified maleic acid resins, acrylic resins, methacrylic resins, poly(vinyl acetate), silicone resins, polyester resins, polyurethane resins, polyamide resins, furan resins, epoxy resins, xylene resins, polyethylene resins, polypropylene resins, and the like.

Of these, it is preferable to incorporate a modified polyethylene resin and/or crystalline polyester resin having a melting point of at least 50° C. and not more than 100° C.

For example, in cases where a carboxyl group-containing modified polyethylene resin is contained as a binder resin, carboxyl groups in the modified polyethylene resin form hydrogen bonds with hydroxyl groups on the surface of paper, thereby increasing adhesive properties between the toner and the paper surface and improving fixability.

This modified polyethylene resin means resins obtained by random copolymerization, block copolymerization or graft copolymerization of another component to a polyolefin resin containing polyethylene as a primary component, as well as resins obtained by modifying such resins by means of polymer reactions.

Examples of copolymerization components include acrylic acid, methacrylic acid, maleic acid, maleic anhydride, itaconic acid, methyl (meth)acrylate, ethyl (meth) acrylate and butyl (meth)acrylate. Specifically, ethylene-acrylic acid copolymers and ethylene-methacrylic acid copolymers are preferred.

From the perspectives of improving adhesive properties between the toner and paper and improving charging performance, the acid value of the modified polyethylene resin is preferably at least 50 mg KOH/g and not more than 300 mg KOH/g, and more preferably at least 80 mg KOH/g and not more than 200 mg KOH/g.

In addition, the content of the modified polyethylene resin in the binder resin is preferably at least 10 mass % and not more than 30 mass %.

When the content of the modified polyethylene resin falls within the range mentioned above, it is possible to increase adhesive properties to paper without causing a decrease in charging performance.

From the perspective of blocking resistance of the toner following long term storage, the melt flow rate of the modified polyethylene resin is preferably not more than 200 [g/10 min].

In addition, the melt flow rate of the modified polyethylene resin is preferably at least 10 [g/10 min] from the perspective of adhesive properties between the toner and paper.

Moreover, the melt flow rate of the modified polyethylene resin can be measured using a method similar to that used for measuring the melt flow rate of the ethylene-vinyl acetate copolymer.

From the perspective of low temperature fixability and storability, the melting point of the modified polyethylene resin is preferably at least 50° C. and not more than 100° C. When the melting point is not more than 100° C., low temperature fixability are further improved. In addition, when the melting point is not more than 90° C., low-temperature fixability are even further improved. Meanwhile, when the melting point is at least 50° C., storability is improved.

The melting point of the modified polyethylene resin can be measured using a differential scanning calorimeter (DSC). Specifically, 0.01 to 0.02 g of a sample is measured precisely into an aluminum pan, and a DSC curve is obtained by increasing the temperature from 0° C. to 200° C. at a ramp rate of 10° C./min. The peak temperature of the maximum endothermic peak on the obtained DSC curve is the melting point.

In cases where a crystalline polyester resin is contained as a binder resin, it is possible to lower the kinematic viscosity when heating and fusing the toner and obtain an image having high gloss even if an ethylene-vinyl acetate copolymer having a small melt flow rate is contained in the toner.

In addition, in cases where the toner contains a colorant, the crystalline polyester resin acts as a colorant dispersing agent and it is possible to increase the dispersibility of the colorant in the ethylene-vinyl acetate copolymer and obtain a toner-fixed object having a high image density. Furthermore, the crystalline polyester resin acts as a crystal nucleating agent for the ethylene-vinyl acetate copolymer, and blocking resistance following long term storage and charging performance are improved.

In addition, the content of the crystalline polyester resin in the binder resin is preferably at least 10 mass % and not more than 30 mass %. When the content of the crystalline polyester resin falls within this range, it is possible to adequately achieve a kinematic viscosity-lowering effect and an effect as a crystal nucleating agent without causing a decrease in charging performance.

The crystalline polyester resin is not particularly limited, but may contain monomer units derived from an alcohol and monomer units derived from a carboxylic acid.

In addition, from the perspectives of ester group concentration and melting point, the crystalline polyester resin preferably contains monomer units derived from an aliphatic diol having at least 4 and not more than 20 carbon atoms and monomer units derived from an aliphatic dicarboxylic acid having at least 4 and not more than 20 carbon atoms.

Moreover, a crystalline resin is a resin for which an endothermic peak is observed in differential scanning calorimetric measurements (DSC).

Specific examples of the diol are as follows.

Ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, 1,20-eicosane diol, 2-methyl-1,3-propane diol, cyclohexane diol and cyclohexane dimethanol. It is possible to use one of these diols in isolation, or a combination of two or more types thereof.

Specific examples of the dicarboxylic acid are as follows.

Oxalic acid, malonic acid, maleic acid, fumaric acid, citraconic acid, itaconic acid, glutaconic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid. It is possible to use one of these dicarboxylic acids in isolation, or a combination of two or more types thereof.

From the perspectives of improving pigment dispersibility and improving charging performance in high humidity environments, the acid value of the crystalline polyester resin is preferably at least 5 mg KOH/g and not more than 30 mg KOH/g.

Moreover, the acid value of the crystalline polyester resin can be measured using a method similar to that used to measure the acid value of the modified polyethylene resin.

The weight average molecular weight (Mw) of the crystalline polyester resin is preferably at least 5000 and not more than 50,000, and more preferably at least 5000 and not more than 20,000.

By setting the weight average molecular weight (Mw) of the crystalline polyester resin to be not more than 50,000, the ethylene-vinyl acetate copolymer is plasticized, the toner can be easily formed using the method described below, and low temperature fixability is improved. In addition, by setting the weight average molecular weight (Mw) to be at least 5000, it is possible to increase the strength of the toner.

Moreover, the weight average molecular weight (Mw) of the crystalline polyester resin can be easily controlled by altering a variety of publicly known production conditions for crystalline resins.

From the perspectives of low temperature fixability and storability, the melting point of the crystalline polyester resin is preferably at least 50° C. and not more than 100° C., and more preferably at least 50° C. and not more than 90° C.

The melting point of the crystalline polyester resin can be measured using a differential scanning calorimeter (DSC). Specifically, 0.01 to 0.02 g of a sample is measured precisely into an aluminum pan, and a DSC curve is obtained by increasing the temperature from 0° C. to 200° C. at a ramp rate of 10° C./min. The peak temperature of the maximum endothermic peak on the obtained DSC curve is the melting point.

The degree of crystallinity of the crystalline polyester resin is preferably at least 10% and not more than 60%, and more preferably at least 20% and not more than 60%. When the degree of crystallinity is at least 10%, the crystalline polyester resin serves as a crystal nucleating agent for the ethylene-vinyl acetate copolymer and it is possible to increase the crystallinity of the toner as a whole and prevent blocking during storage.

The polysiloxane derivative A is a compound represented by structural formula 1 below.

(Structural formula 1)

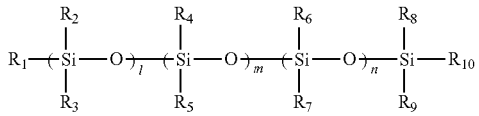

(In the structural formula 1, $R_1$ to $R_{10}$ each independently represent a methyl group or a phenyl group, and l, m and n each independently represent an integer of at least 1.)

The content of the polysiloxane derivative A is preferably at least 5 parts by mass and not more than 30 parts by mass, and more preferably at least 10 parts by mass and not more than 20 parts by mass, relative to 100 parts by mass of the binder resin.

When the content of the polysiloxane derivative A falls within this range, it is possible to sufficiently improve hot offset resistance.

In addition, from the perspectives of suppressing plasticization of the binder resin and improving the speed of migration into the surface layer when thermally fixing the toner, the kinematic viscosity at 25° C. of the polysiloxane derivative A is preferably at least 5 $mm^2/s$ and not more than 3000 $mm^2/s$, more preferably at least 5 $mm^2/s$ and not more than 1000 $mm^2/s$, further preferably at least 50 $mm^2/s$ and not more than 1000 $mm^2/s$, and particularly preferably at least 50 $mm^2/s$ and not more than 300 $mm^2/s$.

Examples of the polysiloxane derivative A include dimethylpolysiloxane, methylphenylpolysiloxane and diphenylpolysiloxane, but dimethylpolysiloxane is preferred.

The polysiloxane derivative B is a compound represented by structural formula 2 below.

(Structural formula 2)

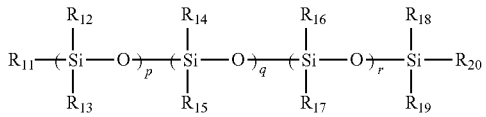

(In the structural formula 2, at least one of $R_{11}$ to $R_{20}$ is an organic group having a $C_{4-30}$ alkyl group, a $C_{4-30}$ alkoxy group, an acrylic group, an amino group, a methacrylic group or a carboxyl group, the remaining groups among $R_{11}$ to $R_{20}$ each independently represent a methyl group or a phenyl group, and p, q and r each independently represent an integer of at least 1.)

Specific examples of the polysiloxane derivative B include compounds having organic groups in some of the side chains of dimethylpolysiloxane, compounds having organic groups at both terminals of dimethylpolysiloxane and compounds obtained by introducing an organic group to one terminal of dimethylpolysiloxane. In addition, examples of such organic groups include groups selected from among long chain ($C_{4-30}$) alkyl groups, long chain ($C_{4-30}$) alkoxy groups, acrylic groups, amino groups, methacrylic groups and carboxyl groups. In addition, these organic groups may be $C_{1-8}$ carboxyalkyl groups or polymers such as acrylic acid-acrylic acid ($C_{4-30}$) alkyl ester copolymers, acrylic acid-methacrylic acid ($C_{4-30}$) alkyl ester copolymers, methacrylic acid-acrylic acid ($C_{4-30}$) alkyl ester copolymers and methacrylic acid-methacrylic acid ($C_{4-30}$) alkyl ester copolymers.

More specifically, examples thereof include stearoxymethicone-dimethylpolysiloxane copolymers, acrylic polymer-dimethylpolysiloxane copolymers, carboxyl-modified silicone oils and polyether-modified silicone oils.

The content of the polysiloxane derivative B is preferably at least 5 parts by mass and not more than 50 parts by mass, and more preferably at least 10 parts by mass and not more than 50 parts by mass, relative to 100 parts by mass of the polysiloxane derivative A.

When the content of the polysiloxane derivative B falls within this range, it is possible to achieve a satisfactory content of the polysiloxane derivative A in the toner, prevent excessive plasticization of the binder resin and improve blocking resistance.

In addition, in cases where the polysiloxane derivative B has a melting point, organic group moieties in the polysiloxane derivative B crystallize in the toner and it is possible to prevent excessive plasticization of the binder resin.

From the perspective of low temperature fixability, the melting point of the polysiloxane derivative B is preferably at least 20° C. and not more than 70° C., and more preferably at least 30° C. and not more than 60° C.

Moreover, the melting point of the polysiloxane derivative B can be measured using a similar method to that used to measure the melting point of the crystalline polyester resin.

In addition, in cases where the polysiloxane derivative B is a liquid, the kinematic viscosity at 25° C. of the polysiloxane derivative B is preferably at least 5 $mm^2/s$ and not more than 3000 $mm^2/s$, and more preferably at least 50 $mm^2/s$ and not more than 1000 $mm^2/s$.

The compatibility of the binder resin and the polysiloxane derivative can be evaluated by means of softening point (Tm).

The softening point is measured using a constant load extrusion type capillary rheometer "Flow Tester CFT-500D Flow Characteristics Analyzer" (available from Shimadzu Corporation), with the measurements being carried out in accordance with the manual provided with the apparatus.

In this apparatus, the temperature of a measurement sample filled in a cylinder is increased, a constant load is applied from above by a piston, thereby melting the sample, and the molten sample is extruded through a die at the bottom of the cylinder, and a flow curve can be obtained from the amount of piston travel and the temperature during this process.

In the present invention, the softening temperature was taken to be the "melting temperature by the half method" described in the manual provided with the "Flow Tester CFT-500D Flow Characteristics Analyzer".

The melting temperature by the half method is calculated as follows.

First, half of the difference between the amount of piston travel at the completion of outflow (Smax) and the amount of piston travel at the start of outflow (Smin) is determined (This is designated as X. X=(Smax−Smin)/2). Next, the temperature in the flow curve when the amount of piston travel reaches the sum of X and Smin is taken to be the melting temperature by the half method.

The measurement sample is prepared by subjecting approximately 1.2 g of a sample to compression molding for approximately 60 seconds at approximately 10 MPa in a 25° C. environment using a tablet compression molder (for example, a Standard Manual Newton Press NT-100H available from NPa System Co., Ltd.) to provide a cylindrical shape with a diameter of approximately 8 mm.

The measurement conditions for the Flow Tester CFT-500D are as follows.

Test mode: rising temperature method
Start temperature: 60° C.
End point temperature: 200° C.
Measurement interval: 1.0° C.
Ramp rate: 4.0° C./min
Piston cross section area: 1.000 $cm^2$
Test load (piston load): 5.0 kgf
Preheating time: 300 sec
Diameter of die orifice: 1.0 mm
Die length: 1.0 mm When the softening point of the binder resin is denoted by $Tm_0$ (° C.) and the softening point of a mixture obtained by heating and kneading the binder resin and the polysiloxane derivative A at a mass ratio of 100:10 is denoted by $Tm_1$ (° C.), it is preferable for the relationship $0.0 \leq [Tm_0 - Tm_1] \leq 3.0$ to be satisfied, and more preferable for the relationship $0.0 \leq [Tm_0 - Tm_1] \leq 2.0$ to be satisfied.

When the value of $[Tm_0 - Tm_1]$ falls within this range, the polysiloxane derivative A in the inner part of the toner readily migrates to the surface of the toner during thermal fixing, and hot offset resistance is further improved.

Meanwhile, when the softening point of a mixture obtained by heating and kneading the binder resin and the polysiloxane derivative B at a mass ratio of 100:10 is denoted by $Tm_2$ (° C.), it is preferable for the relationship $5.0 \leq [Tm_0 - Tm_2] \leq 12.0$ to be satisfied, and more preferable for the relationship $5.0 \leq [Tm_0 - Tm_2] \leq 9.0$ to be satisfied.

When the value of $[Tm_0 - Tm_2]$ falls within this range, the affinity of organic group moieties in the polysiloxane derivative B for the binder resin is sufficient and the polysiloxane derivatives A and B can be sufficiently introduced. In addition, it is possible to prevent excessive plasticization of the binder resin.

The toner may contain an aliphatic hydrocarbon compound having a melting point of at least 50° C. and not more than 100° C.

From the perspectives of low temperature fixability and charging performance, the content of the aliphatic hydrocarbon compound is preferably at least 1 parts by mass and not more than 40 parts by mass, and more preferably at least 10 parts by mass and not more than 30 parts by mass, relative to 100 parts by mass of the binder resin.

When heated, the aliphatic hydrocarbon compound can plasticize the ethylene-vinyl acetate copolymer. Therefore, by incorporating an aliphatic hydrocarbon compound in the toner, the ethylene-vinyl acetate copolymer, which forms a matrix in heat fixing of the toner, is plasticized and low temperature fixability can be further increased.

Furthermore, an aliphatic hydrocarbon compound having a melting point of at least 50° C. and not more than 100° C. can also act as a crystal nucleating agent for the ethylene-vinyl acetate copolymer. Therefore, microscopic movements of the ethylene-vinyl acetate copolymer are suppressed, and charging performance is improved.

Examples of the aliphatic hydrocarbon compound include aliphatic hydrocarbons having at least 20 and not more than 60 carbon atoms, such as hexacosane, triacontane and hexatriacontane.

The toner may contain a colorant. Examples of the colorant include publicly known organic pigments and oil-based dyes, carbon black and magnetic materials.

Copper phthalocyanine compounds and derivatives thereof, anthraquinone compounds, basic dye lake compounds, and the like, may be contained as cyan colorants.

Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

Condensed azo compounds, diketopyrrolopyrrole compounds, anthraquinone compounds, quinacridone compounds, basic dye lake compounds, naphthol compounds, benzimidazolone compounds, thioindigo compounds, perylene compounds, and the like, may be contained as magenta colorants.

Specific examples thereof include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

Condensed azo compounds, isoindolinone compounds, anthraquinone compounds, azo metal complexes, methine compounds, allylamide compounds, and the like, may be contained as yellow colorants.

Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

Examples of black colorants include carbon black, magnetic materials and materials colored black using the yellow colorants, magenta colorants and cyan colorants mentioned above.

These colorants can be used singly or as a mixture, and can be used in the form of solid solutions. These colorants are selected in view of hue angle, chroma, lightness, light-fastness, OHP transparency and dispersibility in the toner.

The content of the colorant is preferably at least 1 part by mass and not more than 20 parts by mass relative to 100 parts by mass of the binder resin.

From the perspective of obtaining a high resolution image, the volume-based median diameter of the toner is preferably at least 3.0 μm and not more than 10.0 μm, and more preferably at least 4.0 μm and not more than 7.0 μm.

Moreover the volume-based median diameter of the toner is preferably measured using a particle size distribution analyzer that uses the Coulter principle (Coulter Multisizer III: available from Beckman Coulter, Inc.).

Any arbitrary method can be used as the toner production method, but it is preferable to use an emulsion aggregation method, by which the particle diameter and particle size distribution of the toner can be easily controlled.

The method for producing a toner of the present invention (hereinafter referred to simply as the production method of the present invention) is characterized by including:

a step of emulsifying a polysiloxane derivative A represented by structural formula 1 and a polysiloxane derivative B represented by structural formula 2 so as to obtain emulsified particles of the polysiloxane derivative A and the polysiloxane derivative B;

a step of finely pulverizing a binder resin containing an ethylene-vinyl acetate copolymer so as to obtain resin fine particles;

a step of aggregating the emulsified particles and the resin fine particles so as to obtain aggregates; and a fusion step of fusing the aggregates.

This emulsion aggregation method is a production method in which the toner particles are produced by first preparing a resin fine particle-dispersed solution that are substantially smaller than the desired particle diameter and then aggregating these resin fine particles in an aqueous medium.

A method for producing a toner using an emotion aggregation method will now be disclosed in detail, but is not limited thereto.

Step of Obtaining Emulsified Particles of Polysiloxane Derivatives

In this step, emulsified particles of polysiloxane derivatives are prepared by emulsifying the polysiloxane derivatives in an aqueous medium.

The emulsified particles of the polysiloxane derivatives are prepared using a publicly known method. The emulsified particles are preferably prepared using, for example, a rotating shear-type homogenizer, a media-based dispersing device, such as a ball mill, a sand mill or an attritor, or a high-pressure counter-collision type dispersing device.

Specifically, an emulsion solution containing emulsified particles of the polysiloxane derivatives are preferably prepared by mixing the polysiloxane derivatives in an aqueous medium in which a surfactant is dissolved, and applying a shear force by using the dispersing device to the aqueous medium in which the polysiloxane derivatives are contained to emulsify the polysiloxane derivatives.

The emulsification step may be carried out using one type of polysiloxane derivative in isolation, but because the polysiloxane derivative B facilitates introduction of the polysiloxane derivative A into the binder resin, it is preferable to include a step of mixing the polysiloxane derivative A with the polysiloxane derivative B prior to the emulsification.

Moreover, in cases where a polysiloxane derivative has a melting point, it is preferable to heat the aqueous medium and the polysiloxane derivatives to the melting point of this polysiloxane derivative or higher, and then carry out the emulsification step.

The added amount of the polysiloxane derivatives is preferably at least 5 mass % to 40 mass % in the aqueous medium.

The type of surfactant is not particularly limited, but examples thereof include anionic surfactants such as sulfate ester salts, sulfonic acid salts, carboxylic acid salts, phosphate esters, and soaps; cationic surfactants such as amine salts and quaternary ammonium salts; and non-ionic surfactants such as polyethylene glycol types, adducts of ethylene oxide to alkylphenols, and polyhydric alcohol types.

It is possible to use one of these surfactants in isolation, or a combination of two or more types thereof.

The volume-based median diameter of the emulsified particles of the polysiloxane derivatives in the emulsion solution of the polysiloxane derivative is preferably at least 0.05 μm and not more than 0.5 μm, and more preferably at least 0.05 μm and not more than 0.4 μm.

Moreover, the volume-based median diameter is preferably measured using a dynamic light scattering particle size distribution analyzer (Nanotrac UPA-EX150 available from Nikkiso Co., Ltd.).

Step of Obtaining Resin Fine Particles

The resin fine particles can be produced using a publicly known method, but are preferably produced using the following method, for example.

A homogeneous solution is formed by dissolving a binder resin containing an ethylene-vinyl acetate copolymer, for example an ethylene-vinyl acetate copolymer and, if necessary, a modified polyethylene resin and/or a crystalline polyester resin, in an organic solvent.

A mixed solution is then prepared by adding a basic compound and, if necessary, a surfactant. Resin fine particles are then formed by adding an aqueous medium to the mixed solution.

Finally, a resin fine particle-dispersed solution, in which the resin fine particles are dispersed in the aqueous medium, is prepared by removing the organic solvent.

In cases where resin fine particles are formed using a method in which the ethylene-vinyl acetate copolymer and the modified polyethylene resin and/or the crystalline polyester resin are co-emulsified, the modified polyethylene resin and/or crystalline polyester resin and the ethylene-vinyl acetate copolymer are mixed together in the resin fine particles. As a result, polar groups in the modified polyethylene resin and/or crystalline polyester resin increase the dispersion stability of the emulsion solution, thereby enabling the particle size distribution of the toner to be easily controlled.

Specifically, a mixed solution is prepared by heating and dissolving the ethylene-vinyl acetate copolymer and the modified polyethylene resin and/or crystalline polyester resin in an organic solvent, and then adding a basic compound and, if necessary, a surfactant to the obtained solution. Next, a resin-containing co-emulsion solution (a resin fine particle-dispersed solution) is prepared by slowly adding the aqueous medium while applying a shear force by means of a homogenizer or the like. Alternatively, a resin-containing co-emulsion solution is prepared by adding the aqueous medium and then applying a shear force by means of a homogenizer or the like.

A resin fine particle co-emulsion solution (a resin fine particle-dispersed solution) is then prepared by heating or lowering the pressure so as to remove the organic solvent.

The concentration of the resin component dissolved in the organic solvent is preferably at least 10 mass % and not more than 50 mass %, and more preferably at least 30 mass % and not more than 50 mass %, relative to the organic solvent.

Any solvent capable of dissolving the resin can be used as the organic solvent, but solvents having high solubility for the ethylene-vinyl acetate copolymer, such as toluene, xylene and ethyl acetate, are preferred.

The type of surfactant is not particularly limited, but examples thereof include anionic surfactants such as sulfate ester salts, sulfonic acid salts, carboxylic acid salts, phosphate esters and soaps; cationic surfactants such as amine salts and quaternary ammonium salts; and non-ionic surfactants such as polyethylene glycol types, adducts of ethylene oxide to alkylphenols, and polyhydric alcohol types.

In addition, from the perspective of controlling particle diameter, it is preferable to use a combination of a sulfonic acid salt type and a carboxylic acid salt type in the step of obtaining aggregates, which is described later.

Examples of the basic compound include inorganic compounds such as sodium hydroxide and potassium hydroxide, and organic compounds such as triethylamine, trimethylamine, dimethylaminoethanol and diethylaminoethanol. It is possible to use one of these basic compounds in isolation, or a combination of two or more types thereof.

The volume-based median diameter of the resin fine particles is preferably at least 0.05 μm and not more than 1.0 μm, and more preferably at least 0.1 μm and not more than 0.6 μm. When the median diameter falls within this range, toner particles having the desired particle diameter can be easily obtained.

Moreover, the volume-based median diameter is preferably measured using a dynamic light scattering particle size distribution analyzer (Nanotrac UPA-EX150 available from Nikkiso Co., Ltd.).

Step of Obtaining Aggregates

In the step of obtaining aggregates, a mixed solution is prepared by mixing the dispersed solution of emulsified particles of the polysiloxane derivatives, the resin fine particle-dispersed solution and, if necessary, the colorant fine particle-dispersed solution and the aliphatic hydrocarbon compound fine particle-dispersed solution. Next, aggregates are formed by aggregating the particles contained in the thus prepared mixed solution.

A method comprising adding an aggregating agent to the mixed solution, mixing and then raising the temperature or applying a mechanical force as appropriate can be advantageously used as the method for forming aggregates.

The colorant fine particle-dispersed solution is prepared by dispersing the colorant in an aqueous medium or the like.

The aliphatic hydrocarbon compound fine particle-dispersed solution is prepared by dispersing the aliphatic hydrocarbon compound in an aqueous medium or the like.

The colorant fine particles and aliphatic hydrocarbon compound fine particles are dispersed using a publicly known method, but a rotating shear-type homogenizer, a media-based dispersing device, such as a ball mill, a sand mill or an attritor, or a high-pressure counter-collision type dispersing device, or the like can be advantageously used. In addition, a surfactant or polymer dispersing agent that imparts dispersion stability may be added if necessary.

Examples of the aggregating agent include metal salts of monovalent metals such as sodium and potassium; metal salts of divalent metals such as calcium and magnesium; metal salts of trivalent metals such as iron and aluminum; and polyvalent metal salts such as polyaluminum chloride.

From the perspective of controlling the particle diameter in this step, it is preferable to use a combination of a divalent metal salt, such as calcium chloride or magnesium sulfate, and a polyvalent metal salt such as polyaluminum chloride.

The aggregating agent is preferably added and mixed at a temperature of at least room temperature and not more than 65° C. By mixing under these temperature conditions, aggregation progresses in a stable state. The mixing can be carried out using a publicly known mixing apparatus, homogenizer, mixer, or the like.

The volume-based median diameter of aggregates formed in this step is not particularly limited, but in general is preferably controlled to at least 4.0 μm and not more than 7.0

μm so as to be similar to the volume-based median diameter of the toner particles to be obtained. This control can be easily carried out by appropriately specifying or altering the temperature when adding and mixing the aggregating agent or stirring and mixing conditions.

Moreover the volume-based median diameter of the aggregates is preferably measured using a particle size distribution analyzer that uses the Coulter principle (Coulter Multisizer III: available from Beckman Coulter, Inc.).

Fusion Step

In the fusion step, the aggregates are heated to a temperature that is not lower than the melting point of the ethylene-vinyl acetate copolymer so as to fuse the aggregates. In this step, resin particles are obtained by smoothing the surfaces of aggregates.

Moreover, in cases where the aggregates contain a modified polyethylene resin and/or a crystalline polyester resin, it is preferable to heat the aggregates to a temperature that is not lower than the melting points of these resins.

In order to prevent melt adhesion between aggregates, a chelating agent, a pH-adjusting agent, a surfactant, or the like, may be introduced as appropriate prior to the fusion step.

Examples of chelating agents include ethylenediaminetetraacetic acid (EDTA) and salts thereof with an alkali metal, such as the sodium salt, sodium gluconate, sodium tartrate, potassium citrate, sodium citrate, nitrilotriacetate (NTA) salts, and a large number of water-soluble polymers that contain both COOH and OH groups (polyelectrolytes).

The heating temperature may be arbitrarily set within a range that is not lower than the melting point of the ethylene-vinyl acetate copolymer and the temperature at which the ethylene-vinyl acetate copolymer thermally decomposes.

The thermal fusion duration may be a shorter duration when a higher heating temperature is used, but must be a longer duration when a lower heating temperature is used. That is, the thermal fusion duration is generally at least 10 minutes and not more than 10 hours, although this depends on the heating temperature, and cannot therefore be unconditionally specified.

Following the fusion step, it is preferable to cool the resin particles obtained in the fusion step to a temperature that is lower than the crystallization temperature of the ethylene-vinyl acetate copolymer (hereinafter also referred to as the cooling step).

By cooling to a temperature that is lower than the crystallization temperature of the ethylene-vinyl acetate copolymer, it is possible to prevent generation of coarse particles. The cooling rate is preferably about at least 0.1° C/min and not more than 50° C/min.

In addition, during or after the cooling, it is possible to carry out annealing by maintaining a temperature at which the speed of crystallization of the ethylene-vinyl acetate copolymer is rapid so as to facilitate crystallization. That is, by maintaining a temperature of at least 30° C. and not more than 70° C. during or after the cooling, crystallization is facilitated and blocking resistance of the toner during storage is improved.

The resin particles produced by means of this step are repeatedly washed and filtered so as to enable removal of impurities in the resin particles. Specifically, by repeatedly washing the resin particles with pure water or an alcohol such as methanol or ethanol and then filtering, it is possible to remove metal salts, surfactants, and the like, in the resin particles. From the perspective of production efficiency, the number of times the resin particles are filtered is preferably 3 to 20, and more preferably 3 to 10.

Toner particles are preferably obtained by drying the washed resin particles.

If necessary, inorganic fine particles, such as silica fine particles, alumina fine particles, titania fine particles or calcium carbonate fine particles, or particles of a resin such as a vinyl resin, a polyester resin or a silicone resin, may be added to the toner particles with the application of shear force in a dry state.

These inorganic fine particles and resin particles function as an external additive such as a flowability aid or a cleaning aid.

Method for Measuring Acid Value

The acid value is the number of milligrams of potassium hydroxide required to neutralize acid components such as free fatty acids and resin acids contained in 1 g of a sample. Acid value is measured in accordance with JIS K 0070-1992, but is specifically measured using the following procedure.

(1) Reagent Preparation

A phenolphthalein solution is obtained by dissolving 1.0 g of phenolphthalein in 90 mL of ethyl alcohol (95 vol. %) and adding ion exchanged water up to a volume of 100 mL.

7 g of special grade potassium hydroxide is dissolved in 5 mL of water, and ethyl alcohol (95 vol. %) is added up to a volume of 1 L. A potassium hydroxide solution is obtained by placing the obtained solution in an alkali-resistant container so as not to be in contact with carbon dioxide gas or the like, allowing solution to stand for 3 days, and then filtering. The obtained potassium hydroxide solution is stored in the alkali-resistant container. The factor of the potassium hydroxide solution is determined by placing 25 mL of 0.1 mol/L hydrochloric acid in a conical flask, adding several drops of the phenolphthalein solution, titrating with the potassium hydroxide solution, and determining the factor from the amount of the potassium hydroxide solution required for neutralization. The 0.1 mol/L hydrochloric acid is produced in accordance with JIS K 8001-1998.

(2) Operation (A) Main Test 2.0 g of a pulverized sample is measured precisely into a 200 mL conical flask, 100 mL of a mixed toluene/ethanol (2:1) solution is added, and the sample is dissolved over a period of 5 hours. Next, several drops of the phenolphthalein solution are added as an indicator, and titration is carried out using the potassium hydroxide solution. Moreover, the endpoint of the titration is deemed to be the point when the pale crimson color of the indicator is maintained for approximately 30 seconds.

(B) Blank Test

Titration is carried out in the same way as in the operation described above, except that the sample is not used (that is, only a mixed toluene/ethanol (2:1) solution is used).

(3) The Acid Value is Calculated by Inputting the Obtained Results into the Formula Below.

$$A=[(C-B)\times f\times 5.61]/S$$

Here, A denotes the acid value (mg KOH/g), B denotes the added amount (mL) of the potassium hydroxide solution in the blank test, C denotes the added amount (mL) of the potassium hydroxide solution in the main test, f denotes the factor of the potassium hydroxide solution, and S denotes the mass (g) of the sample.

Method for Measuring Molecular Weight Distribution of Resins and the Like

The molecular weight distribution [number average molecular weight (Mn), weight average molecular weight (Mw) and peak molecular weight (Mp)] of the resins and the like is measured as follows by means of gel permeation chromatography (GPC).

Special grade 2,6-di-t-butyl-4-methylphenol (BHT) is added to gel chromatography use o-dichlorobenzene at a concentration of 0.10 mass %, and dissolved at room temperature. A sample and the BHT-added o-dichlorobenzene are placed in a sample bottle and heated on a hot plate set to 150° C. so as to dissolve the sample.

Once dissolved, the sample is placed in a pre-heated filter unit and disposed in a main body. A material obtained by passing the sample through the filter unit is used as a GPC sample.

Moreover, the sample solution is adjusted so as to have a concentration of approximately 0.15 mass %.

Measurements are carried out using this sample solution under the following conditions.

Apparatus: HLC-8121GPC/HT (available from Tosoh Corporation)

Detector: High temperature RI

Column: 2×TSKgel GMHHR-H HT (available from Tosoh Corporation)

Temperature: 135.0° C.

Solvent: Gel chromatography use o-dichlorobenzene (0.10 mass % of BHT added)

Flow rate: 1.0 mL/min

Injected amount: 0.4 mL

When calculating the molecular weight of the sample, a molecular weight calibration curve is prepared using standard polystyrene resins (product names "TSK Standard Polystyrene F-850, F-450, F-288, F-128, F-80, F-40, F-20, F-10, F-4, F-2, F-1, A-5000, A-2500, A-1000 and A-500", available from Tosoh Corporation).

Method for Measuring Degree of Crystallinity of Crystalline Resin

The degree of crystallinity of the crystalline resin is measured under the following conditions using wide-angle X-ray diffraction.

X-ray diffraction apparatus: D8 ADVANCE available from Bruker AXS

X-ray source: Cu-Kα line (monochromated with a graphite monochromator)

Output: 40 kV, 40 mA

Slit system: slit DS, SS=1°, RS=0.2 mm

Measurement range: 2θ=5° to 60°

Step interval: 0.02°

Scan rate: 1°/min

After pulverizing the crystalline resin using a mortar, a wide-angle X-ray diffraction profile was obtained under the above conditions. The obtained X-ray diffraction profile is separated into crystalline peaks and amorphous scattering, and the degree of crystallinity is calculated from these areas using the following equation.

$$\text{Degree of crystallinity (\%)} = Ic/(Ic+Ia)\times 100$$

Ic denotes the sum of the areas of crystalline peaks detected within the range $5° \leq 2\theta \leq 60°$ Ia denotes the sum of the amorphous scattering areas detected within the range $5° \leq 2\theta \leq 60°$ Method for Measuring Kinematic Viscosity of Polysiloxane Derivatives The kinematic viscosity of the polysiloxane derivatives is measured at 25° C. using a fully automatic micromotion viscometer (available from Viscotech Co., Ltd.)

Method for Measuring Fracture Elongation of Ethylene-Vinyl Acetate Copolymer

The fracture elongation of the ethylene-vinyl acetate copolymer is measured under conditions based on JIS K 7162.

Determination of Structure of Ethylene-Vinyl Acetate Copolymer

The structure of the ethylene-vinyl acetate copolymer can be measured using an ordinary analysis method, such as nuclear magnetic resonance (NMR) or pyrolysis gas chromatography.

For example, the content proportions of monomer units in the ethylene-vinyl acetate copolymer (proportion of monomer units derived from vinyl acetate: 15 mass %) can be calculated by means of $^{1}$H-NMR using the following method.

A solution obtained by dissolving 5 mg of the ethylene-vinyl acetate copolymer in 0.5 mL of deuterated acetone containing tetramethylsilane as a 0.00 ppm internal standard is placed in a sample tube, and subjected to $^{1}$H-NMR spectral measurements in which the repetition time is 2.7 seconds and the number of accumulations is 16.

A peak at 1.14 to 1.36 ppm is attributable to $CH_2$—$CH_2$ in monomer units derived from ethylene, and a peak close to 2.04 ppm is attributable to $CH_3$ in monomer units derived from vinyl acetate. The content proportions of the monomer units are calculated by calculating the ratios of the integrated values of these peaks.

Determination of Structure of Polysiloxane Derivatives

The polysiloxane derivatives contained in the toner can be separated from the toner as hexane-dissolved substances by dispersing the toner in hexane, heating at 50° C. for 10 minutes, filtering, and recovering the filtrate.

The polysiloxane derivative B can be isolated from the mixture of polysiloxane derivatives A and B contained in the hexane by means of recrystallization or the like, and the structure of the polysiloxane derivative B can be determined by means of a known analysis method such as infrared spectroscopy or nuclear magnetic resonance (NMR).

Similarly, the polysiloxane derivative A can be analyzed by analyzing the mixture of polysiloxane derivatives A and B by means of NMR or the like and then eliminating detection data derived from the polysiloxane derivative B.

Specifically, $^{29}$Si-NMR is used as the analysis means.

For example, in cases where a $^{29}$Si-NMR spectrum of dimethylpolysiloxane is measured, a peak attributable to Si—$O(CH_3)_3$ can be observed close to 6 to 8 ppm, and a peak attributable to —O—$Si(CH_3)_2$—O— can be observed close to 20 to 23 ppm.

EXAMPLES

The present invention will now be explained in detail using examples and comparative examples, but modes of the present invention are not limited to these. Moreover, parts and percentages in the examples and comparative examples are based on masses, unless explicitly stated otherwise.

| Production Example of Resin Fine Particle 1-dispersed Solution | |
|---|---|
| Toluene (available from Wako Pure Chemical Industries, Ltd.) | 300 parts |
| Ethylene-vinyl acetate copolymer (A) (Content of monomer units derived from vinyl acetate: 15 mass %, weight average molecular weight (Mw): 110,000, melt flow rate: 12 g/10 min, melting point: 86° C., fracture elongation: 700%) | 100 parts |
| Crystalline polyester resin (B) [Composition (molar ratio) [1,9-nonane diol:sebacic acid = 100:100], number average molecular weight (Mn): 5,500, weight average molecular weight (Mw): 15,500, peak molecular weight (Mp): 11,400, melting point: 72° C., acid value: 13 mg KOH/g] | 25 parts |

The formulation components mentioned above were mixed and dissolved at 90° C.

Separately, 1.2 parts of sodium dodecylbenzene sulfonate, 0.6 parts of sodium laurate and 1.6 parts of N,N-dimethylaminoethanol were added to 700 parts of ion exchanged water, and dissolved by heating at 90° C.

Next, the toluene solution and aqueous solution mentioned above were mixed together and stirred at 7000 rpm using a T.K. Robomix ultrahigh speed stirrer (available from Primix Corporation).

The obtained mixture was then emulsified at a pressure of 200 MPa using a Nanomizer high pressure impact disperser (available from Yoshida Kikai Co., Ltd.).

An aqueous dispersed solution containing resin fine particles 1 at a concentration of 20% (resin fine particle 1-dispersed solution) was then obtained by removing the toluene using an evaporator and adjusting the concentration by means of ion exchanged water.

The volume-based median diameter of the resin fine particles 1 was measured using a dynamic light scattering particle size distribution analyzer (Nanotrac available from Nikkiso Co., Ltd.), and found to be 0.65 μm.

Production Example of Resin Fine Particle 2-dispersed Solution

Resin fine particle 2-dispersed solution was obtained in the same way as in the production example of resin fine particle 1-dispersed solution, except that the crystalline polyester resin (B) was replaced with 25 parts of an ethylene-methacrylic acid copolymer (C) (content of monomer units derived from methacrylic acid: 15 mass %, melt flow rate: 60 g/10 min, melting point: 90° C., acid value: 90 mg KOH/g). The volume-based median diameter of the obtained resin fine particles 2 was 0.55 μm.

Production Example of Resin Fine Particle 3-dispersed Solution

Resin fine particle 3-dispersed solution was obtained in the same way as in the production example of resin fine particle 1-dispersed solution, except that the usage amount of the ethylene-vinyl acetate copolymer (A) was changed to 50 parts, the usage amount of the crystalline polyester resin (B) was changed to 37.5 parts, the usage amount of N, N-dimethylaminoethanol was changed to 4.8 parts, and 37.5 parts of the ethylene-methacrylic acid copolymer (C) was also used. The volume-based median diameter of the obtained resin fine particles 3 was 0.45 μm.

| Production Example of Resin Fine Particle 4-dispersed Solution | |
|---|---|
| Tetrahydrofuran (available from Wako Pure Chemical Industries, Ltd.) | 250 parts |
| Crystalline polyester resin (B) | 25 parts |

-continued

| Production Example of Resin Fine Particle 4-dispersed Solution | |
|---|---|
| Polyester resin (D) [Composition (mol. %) (polyoxypropylene (2.2)-2,2-bis(4-hydroxyphenyl)propane:isophthalic acid:terephthalic acid = 100:50:50), number average molecular weight (Mn): 4,600, weight average molecular weight (Mw): 16,500, peak molecular weight (Mp): 10,400, Mw/Mn: 3.6, softening point (Tm): 122° C., glass transition temperature (Tg): 70° C., acid value: 10 mg KOH/g] | 100 parts |
| Anionic surfactant (Neogen RK available from DKS Co. Ltd.) | 0.6 parts |

The formulation components mentioned above were mixed and dissolved at 50° C.

Next, 2.7 parts of N, N-dimethylaminoethanol was added and stirred at 4000 rpm using a T.K. Robomix ultrahigh speed stirrer (available from Primix Corporation).

400 parts of ion exchanged water was then added at a rate of 1 part/min so as to precipitate resin fine particles. An aqueous dispersed solution containing resin fine particles 4 at a concentration of 20% (resin fine particle 4-dispersed solution) was then obtained by removing the tetrahydrofuran using an evaporator and adjusting the concentration by means of ion exchanged water. The volume-based median diameter of the obtained resin fine particles 4 was 0.20 μm.

| Production Example of Polysiloxane Derivative A1 Emulsion Solution | |
|---|---|
| Polysiloxane derivative A1 (Dimethylsilicone oil, KF96-50CS available from Shin-Etsu Chemical Co., Ltd., kinematic viscosity at 25° C.: 50 $mm^2/s$) | 20.0 parts |
| Anionic surfactant (Neogen RK available from DKS Co. Ltd.) | 1.0 parts |
| Ion exchanged water | 79.0 parts |

An emulsion solution containing polysiloxane derivative A1 at a concentration of 20% was obtained by mixing the components listed above and dispersing for approximately 1 hour using a Nanomizer high pressure impact disperser (available from Yoshida Kikai Co., Ltd.) so as to disperse the polysiloxane derivative A1. The volume-based median diameter of the polysiloxane derivative A1 emulsion particles in the obtained polysiloxane derivative A1 emulsion solution was measured using a dynamic light scattering particle size distribution analyzer (Nanotrac available from Nikkiso Co., Ltd.), and found to be 0.09 μm.

Production Example of Polysiloxane Derivative A2 Emulsion Solution

Polysiloxane derivative A2 emulsion solution was produced using a similar method to that used in the production example of polysiloxane derivative A1 emulsion solution, except that the polysiloxane derivative A1 was replaced with a polysiloxane derivative A2 (dimethylsilicone oil, KF96-1000CS available from Shin-Etsu Chemical Co., Ltd., kinematic viscosity at 25° C.: 1000 $mm^2/s$). The volume-based median diameter of the polysiloxane derivative A2 emulsion particles in the obtained polysiloxane derivative A2 emulsion solution was measured using a dynamic light scattering particle size distribution analyzer (Nanotrac available from Nikkiso Co., Ltd.), and found to be 0.17 μm.

Production Example of Polysiloxane Derivative A3 Emulsion Solution

Polysiloxane derivative A3 emulsion solution was produced using a similar method to that used in the production example of polysiloxane derivative A1 emulsion solution, except that the polysiloxane derivative A1 was replaced with a polysiloxane derivative A3 (dimethylsilicone oil, KF96-3000CS available from Shin-Etsu Chemical Co., Ltd., kinematic viscosity at 25° C.: 3000 $mm^2/s$). The volume-based median diameter of the polysiloxane derivative A3 emulsion particles in the obtained polysiloxane derivative A3 emulsion solution was measured using a dynamic light scattering particle size distribution analyzer (Nanotrac available from Nikkiso Co., Ltd.), and found to be 0.22 μm.

Production Example of Polysiloxane Derivative A4 Emulsion Solution

Polysiloxane derivative A4 emulsion solution was produced using a similar method to that used in the production example of polysiloxane derivative A1 emulsion solution, except that the polysiloxane derivative A1 was replaced with a polysiloxane derivative A4 (methylphenylsilicone oil, KF50-100CS available from Shin-Etsu Chemical Co., Ltd., kinematic viscosity at 25° C.: 100 $mm^2/s$). The volume-based median diameter of the polysiloxane derivative A4 emulsion particles in the obtained polysiloxane derivative A4 emulsion solution was measured using a dynamic light scattering particle size distribution analyzer (Nanotrac available from Nikkiso Co., Ltd.), and found to be 0.27 μm.

| Production Example of Polysiloxane Derivative B1 Emulsion Solution | |
|---|---|
| Polysiloxane derivative B1 (Stearoxymethicone/dimethylpolysiloxane copolymer, KF-7002 available from Shin-Etsu Chemical Co., Ltd., melting point: 45° C.) | 20.0 parts |
| Anionic surfactant (Neogen RK available from DKS Co. Ltd.) | 1.0 parts |
| Ion exchanged water | 79.0 parts |

The components listed above were mixed, and the mixture was heated to 60° C. and stirred at 7000 rpm using a T.K. Robomix ultrahigh speed stirrer (available from Primix Corporation). Polysiloxane derivative B1 emulsion solution was then obtained by emulsifying at a pressure of 200 MPa using a Nanomizer high pressure impact disperser (available from Yoshida Kikai Co., Ltd.). The volume-based median diameter of the polysiloxane derivative B1 emulsion particles in the obtained polysiloxane derivative B1 emulsion solution was measured using a dynamic light scattering particle size distribution analyzer (Nanotrac available from Nikkiso Co., Ltd.), and found to be 0.35 μm.

Production Example of Polysiloxane Derivative B2 Emulsion Solution

Polysiloxane derivative B2 emulsion solution was produced using a similar method to that used for the production example of polysiloxane derivative B1 emulsion solution, except that the polysiloxane derivative B1 was replaced with a polysiloxane derivative B2 (acrylic polymer/dimethylpolysiloxane copolymer, KP-562P available from Shin-Etsu Chemical Co., Ltd., melting point 50° C.). The volume-based median diameter of the polysiloxane derivative B2 emulsion particles in the obtained polysiloxane derivative B2 emulsion solution was measured using a dynamic light scattering particle size distribution analyzer (Nanotrac available from Nikkiso Co., Ltd.), and found to be 0.37 μm.

Production Example of Polysiloxane Derivative B3 Emulsion Solution

Polysiloxane derivative B3 emulsion solution was produced using a similar method to that used for the production example of polysiloxane derivative B1 emulsion solution, except that the polysiloxane derivative B1 was replaced with a polysiloxane derivative B3 (carboxyl-modified silicone oil, X22-162C available from Shin-Etsu Chemical Co., Ltd., kinematic viscosity at 25° C.: 220 $mm^2/s$). The volume-based median diameter of the polysiloxane derivative B3 emulsion particles in the obtained polysiloxane derivative B3 emulsion solution was measured using a dynamic light scattering particle size distribution analyzer (Nanotrac available from Nikkiso Co., Ltd.), and found to be 0.37 μm.

| Production Example of Polysiloxane Derivative A1 + B1 Co-emulsion Solution | |
|---|---|
| Polysiloxane derivative A1 (Dimethylsilicone oil, KF96-50CS available from Shin-Etsu Chemical Co., Ltd., kinematic viscosity at 25° C.: 50 $mm^2/s$) | 20.0 parts |
| Polysiloxane derivative B1 (Stearoxymethicone/dimethylpolysiloxane copolymer, KF-7002 available from Shin-Etsu Chemical Co., Ltd., melting point: 45° C.) | 2.0 parts |
| Anionic surfactant (Neogen RK available from DKS Co. Ltd.) | 1.1 parts |
| Ion exchanged water | 86.9 parts |

The components listed above were mixed, and the mixture was heated to 60° C. and stirred at 7000 rpm using a T.K. Robomix ultrahigh speed stirrer (available from Primix Corporation). Polysiloxane derivative A1 and polysiloxane derivative B1 co-emulsion solution was then obtained by emulsifying at a pressure of 200 MPa using a Nanomizer high pressure impact disperser (available from Yoshida Kikai Co., Ltd.). The volume-based median diameter of the polysiloxane derivative A1 and polysiloxane derivative B1 emulsion particles in the obtained co-emulsion solution was measured using a dynamic light scattering particle size distribution analyzer (Nanotrac available from Nikkiso Co., Ltd.), and found to be 0.32 μm.

| Production Example of Aliphatic Hydrocarbon Compound Fine Particle-dispersed Solution | |
|---|---|
| Aliphatic hydrocarbon compound (HNP-51, melting point 78° C., available from Nippon Seiro Co., Ltd.) | 20.0 parts |
| Anionic surfactant (Neogen RK available from DKS Co. Ltd.) | 1.0 parts |
| Ion exchanged water | 79.0 parts |

The components listed above were placed in a mixing vessel equipped with a stirring device, heated to 90° C. and subjected to dispersion treatment for 60 minutes by being circulated in a Clearmix W-Motion (available from M Technique Co., Ltd.). The dispersion treatment conditions were as follows.

Outer diameter of rotor: 3 cm

Clearance: 0.3 mm

Rotational speed of rotor: 19,000 rpm

Rotational speed of screen: 19,000 rpm

Following the dispersion treatment, an aqueous dispersed solution containing aliphatic hydrocarbon compound fine particles at a concentration of 20% (an aliphatic hydrocarbon compound fine particle-dispersed solution) was obtained by cooling to 40° C. at a rotor rotational speed of 1000 rpm, a screen rotational speed of 0 rpm and a cooling rate of 10° C./min.

The volume-based median diameter of the aliphatic hydrocarbon compound fine particles in the obtained dispersed solution was measured using a dynamic light scattering particle size distribution analyzer (Nanotrac available from Nikkiso Co., Ltd.), and found to be 0.15 μm.

| Production Example of Colorant Fine Particle-dispersed Solution | |
|---|---|
| Colorant (Cyan pigment, Pigment Blue 15:3 available from Dainichiseika Color and Chemicals Mfg. Co., Ltd.) | 10.0 parts |
| Anionic surfactant (Neogen RK available from DKS Co. Ltd.) | 1.5 parts |
| Ion exchanged water | 88.5 parts |

An aqueous dispersed solution containing colorant fine particles at a concentration of 10% (a colorant fine particle-dispersed solution) was prepared by mixing and dissolving the components listed above and dispersing for approximately 1 hour using a Nanomizer high pressure impact disperser (available from Yoshida Kikai Co., Ltd.) so as to disperse the colorant. The volume-based median diameter of the colorant fine particles in the obtained dispersed solution was measured using a dynamic light scattering particle size distribution analyzer (Nanotrac available from Nikkiso Co., Ltd.), and found to be 0.20 μm.

| Production Example of Toner 1 | |
|---|---|
| Resin fine particle 1-dispersed solution | 100 parts |
| Polysiloxane derivative A1 emulsion solution | 10 parts |
| Polysiloxane derivative B1 emulsion solution | 4.5 parts |
| Aliphatic hydrocarbon compound fine particle-dispersed solution | 30 parts |
| Colorant fine particle-dispersed solution | 10 parts |
| Ion exchanged water | 20 parts |

The materials listed above were placed in a round stainless steel flask and mixed, after which 6 parts of a 2% aqueous solution of polyaluminum chloride and 60 parts of a 2% aqueous solution of magnesium sulfate were added.

Next, the obtained mixed solution was dispersed for 10 minutes at 5000 rpm using a homogenizer (Ultratarax T50 available from IKA-Werke GmbH & Co. KG).

The mixed solution was then heated to 60° C. in a heating water bath while appropriately adjusting the speed of rotation of a stirring blade so that the mixed solution was stirred. After maintaining a temperature of 60° C. for 20 minutes, the volume-based median diameter of formed aggregate particles was measured using a Coulter Multisizer III, and it was confirmed that aggregate particles having sizes of approximately 6.0 μm were formed.

240 parts of a 5% aqueous solution of sodium ethylenediaminetetraacetate was then added to the aggregate particle-dispersed solution, 4000 parts of ion exchanged water was then added, and the obtained mixture was heated to 95° C. while continuing the stirring. The aggregate particles were fused together by maintaining a temperature of 95° C. for 1 hour.

Crystallization of the ethylene-vinyl acetate copolymer was then facilitated by cooling to 50° C. and maintaining this temperature for 3 hours. The mixture was then cooled to 25° C., filtered and subjected to solid-liquid separation, and the filtered product was washed thoroughly with ethanol and then with ion exchanged water.

Following completion of the washing, toner particles 1 were obtained by drying the filtered product using a vacuum dryer.

Toner 1 was obtained by dry mixing 100 parts of toner particles 1 with 1.5 parts of hydrophobically treated silica fine particles having a number average primary particle diameter of 10 nm and 2.5 parts of hydrophobically treated silica fine particles having a number average primary particle diameter of 100 nm using a Henschel mixer (available from Mitsui Mining Co., Ltd.). The volume-based median diameter of the obtained toner 1 was 5.2 μm.

Production Example of Toner 2

Toner 2 was obtained in a similar way to the production example of toner 1, except that the amount of the polysiloxane derivative A1 emulsion solution was 25 parts and the amount of the polysiloxane derivative B1 emulsion solution was 11.25 parts. The volume-based median diameter of the obtained toner 2 was 5.3 μm.

Production Example of Toner 3

Toner 3 was obtained in a similar way to the production example of toner 1, except that the resin fine particle 2-dispersed solution was used instead of the resin fine particle 1-dispersed solution. The volume-based median diameter of the obtained toner 3 was 5.1 μm.

Production Example of Toner 4

Toner 4 was obtained in a similar way to the production example of toner 1, except that the amount of the polysiloxane derivative B1 emulsion solution was 1 part. The volume-based median diameter of the obtained toner 4 was 4.9 μm.

Production Example of Toner 5

Toner 5 was obtained in a similar way to the production example of toner 1, except that 11 parts of the polysiloxane derivative A1+B1 co-emulsion solution was used instead of the polysiloxane derivative A1 emulsion solution and polysiloxane derivative B1 emulsion solution. The volume-based median diameter of the obtained toner 5 was 4.9 μm.

Production Example of Toner 6

Toner 6 was obtained in a similar way to the production example of toner 1, except that the polysiloxane derivative A2 emulsion solution was used instead of the polysiloxane derivative A1 emulsion solution. The volume-based median diameter of the obtained toner 6 was 5.6 μm.

Production Example of Toner 7

Toner 7 was obtained in a similar way to the production example of toner 1, except that the polysiloxane derivative B2 emulsion solution was used instead of the polysiloxane derivative B1 emulsion solution. The volume-based median diameter of the obtained toner 7 was 4.9 μm.

Production Example of Toner 8

Toner 8 was obtained in a similar way to the production example of toner 1, except that the resin fine particle 3-dispersed solution was used instead of the resin fine particle 1-dispersed solution. The volume-based median diameter of the obtained toner 8 was 5.1 μm.

Production Example of Toner 9

Toner 9 was obtained in a similar way to the production example of toner 1, except that the amount of the polysiloxane derivative A1 emulsion solution was 3 parts and the amount of the polysiloxane derivative B1 emulsion solution was 1.35 parts. The volume-based median diameter of the obtained toner 9 was 5.3 μm.

Production Example of Toner 10

Toner 10 was obtained in a similar way to the production example of toner 1, except that the amount of the polysiloxane derivative A1 emulsion solution was 40 parts and the amount of the polysiloxane derivative B1 emulsion solution was 18 parts. The volume-based median diameter of the obtained toner 10 was 5.6 μm.

Production Example of Toner 11

Toner 11 was obtained in a similar way to the production example of toner 1, except that the amount of the polysiloxane derivative B1 emulsion solution was 0.3 parts. The volume-based median diameter of the obtained toner 11 was 5.4 μm.

Production Example of Toner 12

Toner 12 was obtained in a similar way to the production example of toner 1, except that the amount of the polysiloxane derivative B1 emulsion solution was 10 parts. The volume-based median diameter of the obtained toner 12 was 5.3 μm.

Production Example of Toner 13

Toner 13 was obtained in a similar way to the production example of toner 1, except that the polysiloxane derivative A3 emulsion solution was used instead of the polysiloxane derivative A1 emulsion solution. The volume-based median diameter of the obtained toner 13 was 5.8 μm.

Production Example of Toner 14

Toner 14 was obtained in a similar way to the production example of toner 1, except that the polysiloxane derivative A4 emulsion solution was used instead of the polysiloxane derivative A1 emulsion solution. The volume-based median diameter of the obtained toner 14 was 5.2 μm.

Production Example of Toner 15

Toner 15 was obtained in a similar way to the production example of toner 1, except that the polysiloxane derivative B3 emulsion solution was used instead of the polysiloxane derivative B1 emulsion solution. The volume-based median diameter of the obtained toner 15 was 5.1 μm.

Production Example of Toner 16

Toner 16 was obtained in a similar way to the production example of toner 1, except that the polysiloxane derivative A1 emulsion solution and the polysiloxane derivative B1 emulsion solution were not used. The volume-based median diameter of the obtained toner 16 was 5.8 μm.

Production Example of Toner 17

Toner 17 was obtained in a similar way to the production example of toner 1, except that the polysiloxane derivative B1 emulsion solution was not used. The volume-based median diameter of the obtained toner 17 was 5.4 μm.

Production Example of Toner 18

Toner 18 was obtained in a similar way to the production example of toner 1, except that the polysiloxane derivative A1 emulsion solution was not used. The volume-based median diameter of the obtained toner 18 was 5.4 μm.

Production Example of Toner 19

Toner 19 was obtained in a similar way to the production example of toner 1, except that the polysiloxane derivative B1 emulsion solution was not used, the amount of the polysiloxane derivative A1 emulsion solution was 5 parts and the amount of the polysiloxane derivative A2 emulsion solution was 5 parts. The volume-based median diameter of the obtained toner 19 was 5.2 μm.

Production Example of Toner 20

Toner 20 was obtained in a similar way to the production example of toner 1, except that the polysiloxane derivative A1 emulsion solution was not used, the amount of the polysiloxane derivative B1 emulsion solution was 5 parts and the amount of the polysiloxane derivative B2 emulsion solution was 5 parts. The volume-based median diameter of the obtained toner 20 was 5.1 μm.

| Production Example of Toner 21 | |
|---|---|
| Resin fine particle 4-dispersed solution | 100 parts |
| Polysiloxane derivative A1 emulsion solution | 10 parts |
| Aliphatic hydrocarbon compound fine particle-dispersed solution | 30 parts |

-continued

| Production Example of Toner 21 | |
|---|---|
| Colorant fine particle-dispersed solution | 10 parts |
| Ion exchanged water | 60 parts |

The materials listed above were placed in a round stainless steel flask and mixed, after which 20 parts of a 2% aqueous solution of magnesium sulfate was added.

Next, the obtained mixed solution was dispersed for 10 minutes at 5000 rpm using a homogenizer (Ultratarax T50 available from IKA-Werke GmbH & Co. KG).

The mixed solution was then heated to 65° C. in a heating water bath while appropriately adjusting the speed of rotation of a stirring blade so that the mixed solution was stirred. After maintaining a temperature of 65° C. for 30 minutes, the volume-based median diameter of formed aggregate particles was measured using a Coulter Multisizer III, and it was confirmed that aggregate particles having sizes of approximately 5.7 μm were formed.

100 parts of a 5% aqueous solution of sodium ethylenediaminetetraacetate was then added to the aggregate particle-dispersed solution, 200 parts of ion exchanged water was then added, and the obtained mixture was heated to 95° C. while continuing the stirring. The aggregate particles were fused together by maintaining a temperature of 95° C. for 5 hours.

The mixture was then cooled to 25° C., filtered, subjected to solid-liquid separation, and then washed with ion exchanged water. Following completion of the washing, toner particles 21 were obtained by drying in a vacuum dryer.

Toner 21 was obtained by dry mixing 100 parts of toner particles 21 with 1.5 parts of hydrophobically treated silica fine particles having a number average primary particle diameter of 10 nm and 2.5 parts of hydrophobically treated silica fine particles having a number average primary particle diameter of 100 nm using a Henschel mixer (available from Mitsui Mining Co., Ltd.). The volume-based median diameter of the obtained toner 21 was 5.0 μm.

Production Example of Toner 22

Toner 22 was obtained in a similar way to the production example of toner 21, except that the polysiloxane derivative A1 emulsion solution was not used and 10 parts of the polysiloxane derivative B1 emulsion solution was used. The volume-based median diameter of the obtained toner 22 was 5.1 μm.

| Production Example of Toner 23 | |
|---|---|
| Ethylene-vinyl acetate copolymer (E) (Content of monomer units derived from vinyl acetate: 20 mass %, melt flow rate: 200 g/10 min, melting point: 75° C., fracture elongation: 210%) | 80 parts |
| Crystalline polyester resin (B) | 20 parts |
| Polysiloxane derivative A1 | 10 parts |
| Aliphatic hydrocarbon compound (HNP-51, melting point 78° C., available from Nippon Seiro Co., Ltd.) | 30 parts |
| Colorant (Cyan pigment, Pigment Blue 15:3 available from Dainichiseika Color and Chemicals Mfg. Co., Ltd.) | 5 parts |

The materials listed above were pre-mixed in a Henschel mixer, and then subjected to melt kneading for a period of 1 hour using a biaxial kneading extruder (PCM-30, available from Ikegai Ironworks Corp.) set to 130° C. and 200 rpm.

Toner particles 23 were obtained by cooling the obtained kneaded product, coarsely pulverizing using a cutter mill, finely pulverizing the coarsely pulverized product using a Turbo Mill T-250 (available from Turbo Kogyo Co., Ltd.), and then classifying the obtained particles using a multiple section sorting apparatus using the Coanda effect.

Toner 23 was obtained by dry mixing 100 parts of toner particles 23 with 1.5 parts of hydrophobically treated silica fine particles having a number average primary particle diameter of 10 nm and 2.5 parts of hydrophobically treated silica fine particles having a number average primary particle diameter of 100 nm using a Henschel mixer (available from Mitsui Mining Co., Ltd.). The volume-based median diameter of the obtained toner 23 was 6.4 μm.

Examples 1 to 15 and Comparative Examples 1 to 8

Toners 1 to 23 were subjected to the following evaluation tests. The evaluation results are shown in Table 2.

Evaluation of Low Temperature Fixability

A two-component developer was prepared by mixing the toner and a ferrite carrier (average particle diameter 42 μm) surface coated with a silicone resin so as to achieve a toner concentration of 8 mass %.

An unfixed toner image (0.6 mg/cm$^2$) was formed on an image-receiving paper (64 g/m$^2$) using a commercially available full color digital copier (CLC1100 available from Canon Inc.).

The fixing unit was removed from a commercially available full color digital copier (imageRUNNER ADVANCE C5051 available from Canon Inc.) and was modified to make the fixing temperature adjustable, and this was used to carry out a fixing test on the unfixed image.

The condition was visually evaluated when the unfixed image was fixed at normal temperature and normal humidity at a process speed of 246 mm/sec.

A: Fixing was possible at a temperature of not more than 120° C.

B: Fixing was possible at a temperature of more than 120° C., but not more than 140° C.

C: Fixing was possible at a temperature of more than 140° C. or there was no temperature region in which fixing was possible Evaluation of Hot Offset Resistance A fixing test was carried out in the same way as in the evaluation of low temperature fixability, and the condition was visually evaluated when the image was fixed.

A: Fixing was possible at a temperature of at least 180° C.

B: Fixing was possible at a temperature of at least 160° C., and hot offset occurred at a temperature of at least 180° C.

C: Fixing was possible at a temperature of not more than 160° C. and hot offset occurred at a temperature of at least 160° C., or there was no temperature region in which fixing was possible Evaluation of Flowability Following Long Term Storage The toner was allowed to stand for a period of one month in a constant-temperature constant-humidity chamber at a temperature of 30° C. and a relative humidity of 50%, after which the degree of blocking was visually evaluated.

A: Blocking did not occur, or the toner could be easily dispersed by light shaking if blocking had occurred B: Blocking occurred, but the toner could be dispersed by continued shaking C: Blocking occurred, and the toner could not be dispersed even by applying force Evaluation of Blocking Resistance The toner was allowed to stand for a period of three days in a constant-temperature constant-humidity chamber at a temperature of 50° C. and a relative humidity of 50%, after which the degree of blocking was visually evaluated.

A: Blocking did not occur, or the toner could be easily dispersed by light shaking even if blocking had occurred B: Blocking occurred, but the toner could be dispersed by continued shaking C: Blocking occurred, and the toner could not be dispersed even by applying force Evaluation of Polysiloxane Derivative Introduction Rate The degree to which the polysiloxane derivatives had been introduced into the completed the toner relative to the charged amount during toner production was evaluated by detecting elemental Si using X-ray fluorescence.

This method will now be explained.

Kneaded products 1 to 23 were obtained by melt kneading binder resins, polysiloxane derivatives A and B and colorants so as to have similar compositional ratios as toner particles 1 to 23 respectively.

Kneaded product thin films 1 to 23, which had sizes that fitted in a trace sample measurement container inner frame 2 described later, were prepared by hot pressing 50 mg of each obtained kneaded product.

Figure 1B:
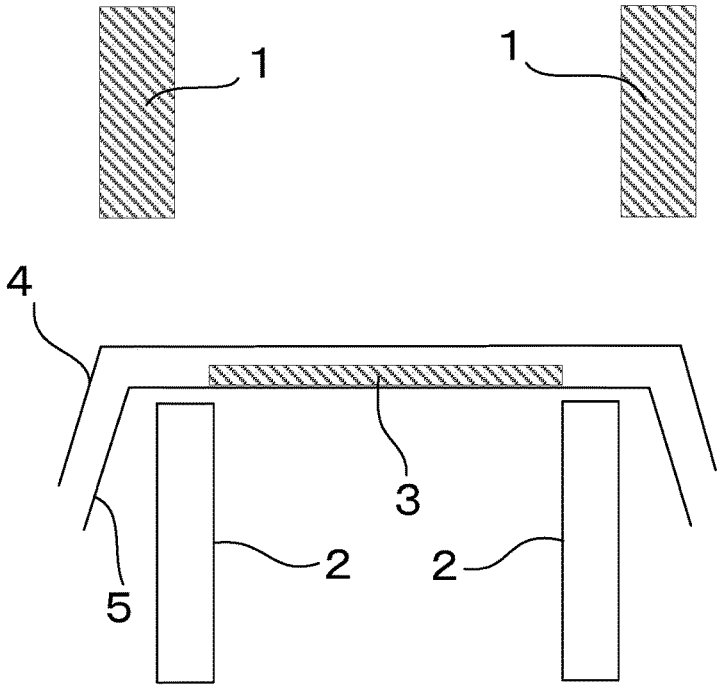

Next, a trace sample measurement container 10 such as that shown in FIGS. 1A and 1B were prepared for each of toner particles 1 to 23 and kneaded product thin films 1 to 23.

The trace sample measurement container 10 is a container in which a trace amount of a powdered or thin film sample can be measured in a vacuum atmosphere and then recovered.

The method for producing the trace sample measurement container 10 is as follows.

A microporous film 5 is made to cover the trace sample measurement container inner frame 2, and 50 mg of toner or a kneaded product thin film (a measurement sample 3) is placed on the microporous film and covered with a covering film 4.

The covering film 4 is fixed by means of a trace sample measurement container outer frame 1.

Moreover, the microporous film 5 is air-permeable, and air can permeate between sample particles.

In addition, the trace sample measurement container outer frame 1 and the trace sample measurement container inner frame 2 are made from polyethylene, the microporous film 5 is made from polypropylene, the cover film 4 is made from prolene, and none of these components contain elemental Si.

In addition, the Kα peak angle of elemental Si is such that 2θ=109.05(°). Next, a calibration curve sample is placed in an X-ray fluorescence analyzer, and the pressure in the sample chamber is reduced so as to obtain a vacuum.

X-ray intensities of the samples were determined under the following conditions.

Measurement Conditions

Apparatus: ZSX100s (available from Rigaku Corporation)

Measurement potential, voltage: 50 kV-50 mA

2θ angle: 109.05)(°)

Crystal plate: PET

Measurement time: 60 sec

X-ray intensities were determined for each toner particle and kneaded product thin film, and polysiloxane derivative introduction rates were determined according to the following formula.

(Formula)"polysiloxane derivative introduction rate"={(X-ray intensity of toner particle)/(X-ray intensity of kneaded product thin film)}×100

TABLE 1

| | | Binder resin | | | | | | | | | | | | | | | |
|---|---|---|---|---|---|---|---|---|---|---|---|---|---|---|---|---|---|
| | | Ethylene-vinyl acetate copolymer | | Binder resin other than ethylene-vinyl acetate copolymer | | | | Polysiloxane derivative A | | | | Polysiloxane derivative B | | | | | |
| Toner No. | Toner production method | Type | Proportion (mass %) in binder resin | Type | Proportion (mass %) in binder resin | Type | Proportion (mass %) in binder resin | Type | X (parts by mass) | Kinematic viscosity ($mm^2/s$) | $Tm_0 - Tm_1$ (° C.) | Type | Y (parts by mass) | Z (parts by mass) | Kinematic viscosity ($mm^2/s$) | Melting point (° C.) | $Tm_0 - Tm_2$ (° C.) |
| 1 | 1 | A | 80 | B | 20 | — | — | A1 | 10 | 50 | 1.1 | B1 | 45 | 4.5 | — | 45 | 8.5 |
| 2 | 1 | A | 80 | B | 20 | — | — | A1 | 25 | 50 | 1.1 | B1 | 45 | 11.25 | — | 45 | 8.5 |
| 3 | 1 | A | 80 | C | 20 | — | — | A1 | 10 | 50 | 0.8 | B1 | 45 | 4.5 | — | 45 | 7.8 |
| 4 | 1 | A | 80 | B | 20 | — | — | A1 | 10 | 50 | 1.1 | B1 | 10 | 1 | — | 45 | 8.5 |
| 5 | 1 | A | 80 | B | 20 | — | — | A1 | 10 | 50 | 1.1 | B1 | 10 | 1 | — | 45 | 8.5 |
| 6 | 1 | A | 80 | B | 20 | — | — | A2 | 10 | 1000 | 0.9 | B1 | 45 | 4.5 | — | 45 | 8.5 |
| 7 | 1 | A | 80 | B | 20 | — | — | A1 | 10 | 50 | 1.1 | B2 | 45 | 4.5 | — | 50 | 5.9 |
| 8 | 1 | A | 40 | B | 30 | C | 30 | A1 | 10 | 50 | 1.0 | B1 | 45 | 4.5 | — | 45 | 5.4 |
| 9 | 1 | A | 80 | B | 20 | — | — | A1 | 3 | 50 | 1.1 | B1 | 45 | 1.35 | — | 45 | 8.5 |
| 10 | 1 | A | 80 | B | 20 | — | — | A1 | 40 | 50 | 1.1 | B1 | 45 | 18 | — | 45 | 8.5 |
| 11 | 1 | A | 80 | B | 20 | — | — | A1 | 10 | 50 | 1.1 | B1 | 3 | 0.3 | — | 45 | 8.5 |
| 12 | 1 | A | 80 | B | 20 | — | — | A1 | 10 | 50 | 1.1 | B1 | 100 | 10 | — | 45 | 8.5 |
| 13 | 1 | A | 80 | B | 20 | — | — | A3 | 10 | 3000 | 0.9 | B1 | 45 | 4.5 | — | 45 | 8.5 |
| 14 | 1 | A | 80 | B | 20 | — | — | A4 | 10 | 100 | 2.1 | B1 | 45 | 4.5 | — | 45 | 8.5 |
| 15 | 1 | A | 80 | B | 20 | — | — | A1 | 10 | 50 | 1.1 | B3 | 45 | 4.5 | 220 | — | 4.5 |
| 16 | 1 | A | 80 | B | 20 | — | — | | | — | | | | | — | | |
| 17 | 1 | A | 80 | B | 20 | — | — | A1 | 10 | 50 | 1.1 | | | | — | | |
| 18 | 1 | A | 80 | B | 20 | — | — | | | — | | B1 | — | 4.5 | — | 45 | 8.5 |
| 19 | 1 | A | 80 | B | 20 | — | — | A1 | 5 | 50 | 1.1 | | | | — | | |
| | | | | | | | | A2 | 5 | 1000 | 0.9 | | | | | | |
| 20 | 1 | A | 80 | B | 20 | — | — | | | — | | B1 | — | 5 | — | 45 | 8.5 |
| | | | | | | | | | | | | B2 | — | 5 | — | 50 | 5.9 |
| 21 | 1 | — | — | B | 20 | D | 80 | A1 | 10 | 50 | 0.1 | | | | — | | |
| 22 | 1 | — | — | B | 20 | D | 80 | | | — | | B1 | | 10 | | 45 | 0.3 |
| 23 | 2 | E | 80 | B | 20 | — | — | A1 | 10 | 50 | 1.2 | | | | — | | |

In table 1,

"1" means emulsion aggregation method and "2" means melt kneading method in the toner production method column.

In the polysiloxane derivative A column, "X" means the proportion (parts by mass) of the polysiloxane derivative A relative to 100 parts by mass of the binder resin.

In the polysiloxane derivative B column, "Y" means the proportion (parts by mass) of the polysiloxane derivative B relative to 100 parts by mass of the polysiloxane derivative A, and "Z" means the proportion (parts by mass) of the polysiloxane derivative B relative to 100 parts by mass of the binder resin.

TABLE 2

| | Toner No. | Polysiloxane derivative introduction rate (%) | Hot offset resistance | Low temperature fixability | Flowability following long term storage | Blocking resistance |
|---|---|---|---|---|---|---|
| Example 1 | 1 | 83.2 | A | A | A | A |
| Example 2 | 2 | 79.8 | A | A | B | B |
| Example 3 | 3 | 82.2 | A | A | A | A |
| Example 4 | 4 | 63.2 | B | B | A | A |
| Example 5 | 5 | 85.7 | A | A | A | A |
| Example 6 | 6 | 81.5 | B | A | A | A |
| Example 7 | 7 | 73.3 | B | A | A | A |
| Example 8 | 8 | 82.1 | A | B | B | A |
| Example 9 | 9 | 84.5 | B | B | A | A |
| Example 10 | 10 | 80.7 | A | A | B | B |
| Example 11 | 11 | 50.1 | B | B | A | A |

TABLE 2-continued

| | Toner No. | Polysiloxane derivative introduction rate (%) | Hot offset resistance | Low temperature fixability | Flowability following long term storage | Blocking resistance |
|---|---|---|---|---|---|---|
| Example 12 | 12 | 81.3 | B | A | B | B |
| Example 13 | 13 | 84.6 | B | A | A | A |
| Example 14 | 14 | 83.6 | B | A | A | B |
| Example 15 | 15 | 68.3 | B | A | B | A |
| Comparative example 1 | 16 | — | C | B | A | A |
| Comparative example 2 | 17 | 13.3 | C | B | B | A |
| Comparative example 3 | 18 | 89.3 | C | A | A | B |
| Comparative example 4 | 19 | 15.5 | C | B | B | A |
| Comparative example 5 | 20 | 87.2 | C | A | B | C |
| Comparative example 6 | 21 | 12.3 | B | C | B | A |
| Comparative example 7 | 22 | 85.3 | A | C | B | A |
| Comparative example 8 | 23 | 98.7 | A | A | C | A |

According to the present invention, it is possible to provide a toner which exhibits good low temperature fixability, excellent hot offset resistance and satisfactory flowability following long term storage, and a method for producing the toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-173352, filed Sep. 6, 2016, and Japanese Patent Application No. 2017-145311, filed Jul. 27, 2017, which are hereby incorporated by reference herein in their entirety.

What is claimed is:

1. A toner comprising:

a binder resin containing an ethylene-vinyl acetate copolymer;

a polysiloxane derivative A represented by formula 1

(1)

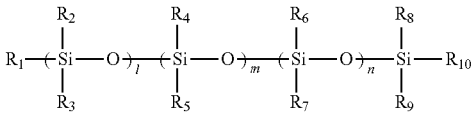

where $R_1$ to $R_{10}$ represent a methyl group, and l, m and n each independently represent an integer of at least 1; and a polysiloxane derivative B represented by formula 2

(2)

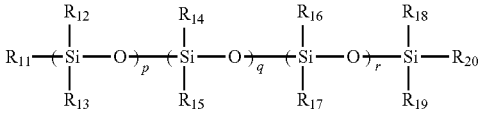

where at least one of $R_{11}$ to $R_{20}$ is a $C_{4-30}$ alkyl group, a $C_{4-30}$ alkoxy group, an acrylic group, an amino group, a methacrylic group or a carboxyl group, the remaining groups among $R_{11}$ to $R_{20}$ each independently represent a methyl group or a phenyl group, and p, q and r each independently represent an integer of at least 1, wherein a content of the polysiloxane derivative A is 5 to 30 parts by mass relative to 100 parts by mass of the binder resin, and a content of the ethylene-vinyl acetate copolymer in the binder resin is 50 to 100 mass %.

2. The toner according to claim 1, wherein a content of the polysiloxane derivative B is 5 to 50 parts by mass relative to 100 parts by mass of the polysiloxane derivative A.

3. The toner according to claim 1, wherein a kinematic viscosity at 25° C. of the polysiloxane derivative A is 5 to 1000 $mm^2/s$.

4. The toner according to claim 1, wherein a melting point of the polysiloxane derivative B is 20 to 70° C.

5. The toner according to claim 1, wherein $0.0 \leq [Tm_0-Tm_1] \leq 3.0$ and $5.0 \leq [Tm_0-Tm_2] \leq 12.0$ when a softening point of the binder resin is denoted by $Tm_0$ (° C.), a softening point of a mixture obtained by heating and kneading the binder resin and the polysiloxane derivative A at a mass ratio of 100:10 is denoted by $Tm_1$ (° C.), and a softening point of a mixture obtained by heating and kneading the binder resin and the polysiloxane derivative B at a mass ratio of 100:10 is denoted by $Tm_2$ (° C).

6. A method for producing a toner, the method comprising:

a step of emulsifying a polysiloxane derivative A represented by formula 1 and a polysiloxane derivative B represented by formula 2 so as to obtain emulsified particles of the polysiloxane derivative A and the polysiloxane derivative B (1)

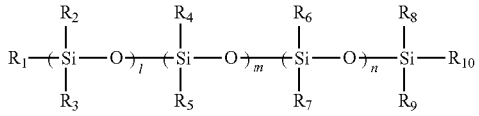

where $R_1$ to $R_{10}$ represent a methyl group, and l, m and n each independently represent an integer of at least 1;

(2)

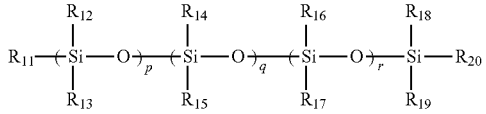

where at least one of $R_{11}$ to $R_{20}$ is a $C_{4-30}$ alkyl group, a $C_{4-30}$ alkoxy group, an acrylic group, an amino group, a methacrylic group or a carboxyl group, the remaining groups among $R_{11}$ to $R_{20}$ each independently represent a methyl group or a phenyl group, and p, q and r each independently represent an integer of at least 1;

a step of finely pulverizing a binder resin containing an ethylene-vinyl acetate copolymer so as to obtain resin fine particle;

a step of aggregating the emulsified particles and the resin fine particles so as to obtain aggregates; and a fusion step of fusing the aggregates, wherein a content of the polysiloxane derivative A is 5 to 30 parts by mass relative to 100 parts by mass of the binder resin, and a content of the ethylene-vinyl acetate copolymer in the binder resin is 50 to 100 mass %.

7. The method for producing a toner according to claim 6, wherein the step of obtaining emulsified particles includes a step of mixing the polysiloxane derivative A represented by formula 1 and the polysiloxane derivative B represented by formula 2 prior to the emulsification.

8. The method for producing a toner according to claim 6, wherein a content of the polysiloxane derivative B is 5 to 50 parts by mass relative to 100 parts by mass of the polysiloxane derivative A.

9. The method for producing a toner according to claim 6, wherein a kinematic viscosity at 25° C. of the polysiloxane derivative A is 5 to 1000 $mm^2/s$.

10. The method for producing a toner according to claim 6, wherein a melting point of the polysiloxane derivative B is 20 to 70° C.

11. The method for producing a toner according to claim 6, wherein $0.0 \leq [Tm_0-Tm_1] \leq 3.0$ and $5.0 \leq [Tm_0-Tm_2] \leq 12.0$ when a softening point of the binder resin is denoted by $Tm_0$(° C.), a softening point of a mixture obtained by heating and kneading the binder resin and the polysiloxane derivative A at a mass ratio of 100:10 is denoted by $Tm_1$ (° C.), and a softening point of a mixture obtained by heating and kneading the binder resin and the polysiloxane derivative B at a mass ratio of 100:10 is denoted by $Tm_2$ (° C).

* * * * *